US007955040B2

(12) United States Patent
Wakabayashi et al.

(10) Patent No.: US 7,955,040 B2
(45) Date of Patent: Jun. 7, 2011

(54) CUTTING DEVICE, FINISHER AND IMAGE FORMING APPARATUS PROVIDED THEREWITH

(75) Inventors: Hiroyuki Wakabayashi, Hachioji (JP); Masaaki Uchiyama, Hachioji (JP); Tsuyoshi Shiokawa, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1126 days.

(21) Appl. No.: 11/714,849

(22) Filed: Mar. 7, 2007

(65) Prior Publication Data

US 2007/0269291 A1 Nov. 22, 2007

(30) Foreign Application Priority Data

May 18, 2006 (JP) ..... 2006-138696
May 18, 2006 (JP) ..... 2006-138697

(51) Int. Cl.
*B42B 9/00* (2006.01)
*B42C 9/00* (2006.01)
*B42C 11/00* (2006.01)

(52) U.S. Cl. ..... 412/16; 412/1; 412/6; 412/8; 412/18; 412/32; 412/37

(58) Field of Classification Search ..... 412/1, 6, 412/8, 16, 18, 32, 37
See application file for complete search history.

(56) References Cited

U.S. PATENT DOCUMENTS 2,982,979 A * 5/1961 Patterson ..... 412/37
6,966,552 B2 * 11/2005 Trovinger et al. ..... 412/16
2004/0096253 A1 5/2004 Ueno et al.

FOREIGN PATENT DOCUMENTS

DE 19621872 C1 5/1996
JP 2005-40890 2/2005
JP 2005-169598 6/2005
JP 2005-271175 10/2005
JP 2005-342854 12/2005

OTHER PUBLICATIONS

European Search Report dated Sep. 20, 2007.

* cited by examiner

*Primary Examiner* — Dana Ross
*Assistant Examiner* — Justin V Lewis
(74) *Attorney, Agent, or Firm* — Finnegan, Henderson, Farabow, Garrett & Dunner, L.L.P.

(57) ABSTRACT

A cutting device that cuts an edge portion of a sheet bundle to an even length, in which a plurality of sheet have been stacked, using a cutting blade, the cutting device includes: a paddle shaft capable of being rotated, which is connected to a drive source provided in the vicinity of the cutting blade; and a plurality of paddles provided on the paddle shaft in a rotary axis direction thereof; wherein the plurality of paddles are arranged in a single line with the same phase as each other on the paddle shaft.

7 Claims, 8 Drawing Sheets

CUTTING DEVICE, FINISHER AND IMAGE FORMING APPARATUS PROVIDED THEREWITH

This application is based on Japanese Patent Application Nos. 2006-138696 filed on May 18, 2006 and 2006-138697 filed on May 18, 2006, which are hereby incorporated by reference.

BACKGROUND OF THE INVENTION

The present invention relates to a cutting device for cutting the edge portion of a sheet bundle made of a plurality of sheets stacked on top of one another; a finisher for finishing the sheet with an image formed thereon ejected from the image forming apparatus, and cutting the edge portion; and an image forming apparatus provided with an image forming section and the finisher.

A finisher equipped with a cutting device for cutting and trimming the edge portion of the booklet having been subjected to the processes of center-binding and center-folding has been used in the field of printing businesses.

Another type of the finisher provided in recent years is a finisher including a cutting device that receives the sheets with an image formed thereon by an image forming apparatus such as a photocopier and printer, applies processes of center-binding and center-folding the sheets and a process of binding the sheets in the form of a book such as a weekly magazine, and then cuts and trims the edge portion of the booklet.

In the cutting device described in the Unexamined Japanese Patent Application Publication No. 2005-40890 (claim 15, FIG. 15), a sheet bundle is held in the vertical direction or obliquely by a holding and rotating section for holding the sheet bundle, and the chips of the sheets generated at the time of cutting the sheet bundle are removed from the vicinity of the cutting blade under its own weight or by an elimination unit.

In the cutting device described in the Unexamined Japanese Patent Application Publication No. 2005-169598 (Paragraph 0080, FIG. 11), the edge of a sheet bundle is cut by back-and-forth motion of a cutting blade, and the chips cut off by a cutting blade are removed by a removal unit away from the vicinity of the cutting blade.

The cutting device disclosed in the Unexamined Japanese Patent Application Publication No. 2005-342854 (claim 1, FIG. 1) is provided with a scraper formed of an elastic thin plate, which is brought in elastic contact with an upper movable blade to remove the chips attached to the upper movable blade.

The cutting device disclosed in the Unexamined Japanese Patent Application Publication No. 2005-271175 (Paragraph 0027, FIG. 5) is provided with a falling paper holder and a rising cutter. A cover is installed as a chip falling cover extending continuously over the blade surface of the cutter tip.

The sheet bundle cutting device described in the Unexamined Japanese Patent Application Publication Nos. 2005-40890 and 2005-169598 removes chips by a rotating paddle engaged with the chips having been cut off. It is not designed to remove the chips attached to the cutting blade.

In the cutting device disclosed in the Unexamined Japanese Patent Application Publication No. 2005-342854, a scraper formed of an elastic thin plate removes the chips sticking to the upper movable blade and drops them under their own weight. This arrangement fails to ensure reliable removal of chips from the vicinity of the leading edge of the movable blade having cut into the sheet bundle when the end of a thick sheet bundle is cut.

The sheet cutting device disclosed in the Unexamined Japanese Patent Application Publication No. 2005-271175 is provided with a falling paper holder and a rising cutter. This is the same as the cutting device of the present invention in this respect, but the chips having been cut off slip down the chip falling cover extending continuously to the blade surface of the cutter tip, and the chips sticking to the cutter tip cannot be removed.

SUMMARY OF THE INVENTION

The following describes one aspect of the present invention.

1. In a cutting device for trimming the edge portion of a sheet bundle in which a plurality of sheets are stacked on top of one another using a cutting blade, the aforementioned cutting device includes: a rotatable paddle shaft arranged in the vicinity of the aforementioned cutting blade and connected to drive source; and a plurality of paddles arranged on the aforementioned paddle shaft in the axial direction thereof, wherein the plurality of the aforementioned paddles are arranged in one row at the same phase on the paddle shaft.

2. In a finisher binding a book by aligning a plurality of sheets, the finisher includes the cutting device described in the above aspect 1 for cutting the edge portion of the sheet bundle having been bound in the form of a book.

3. An image forming apparatus includes: an image forming section for forming an image on a sheet; and the finisher described in the above aspect 2 for forming a bookbound product by using a cutting device to cut the edge portion of the sheet bundle produced by applying a process of finishing to a plurality of sheets with the image formed thereon by the aforementioned image forming section.

DETAILED DESCRIPTION OF THE PREFERRED EMBODIMENT

Figure 1:
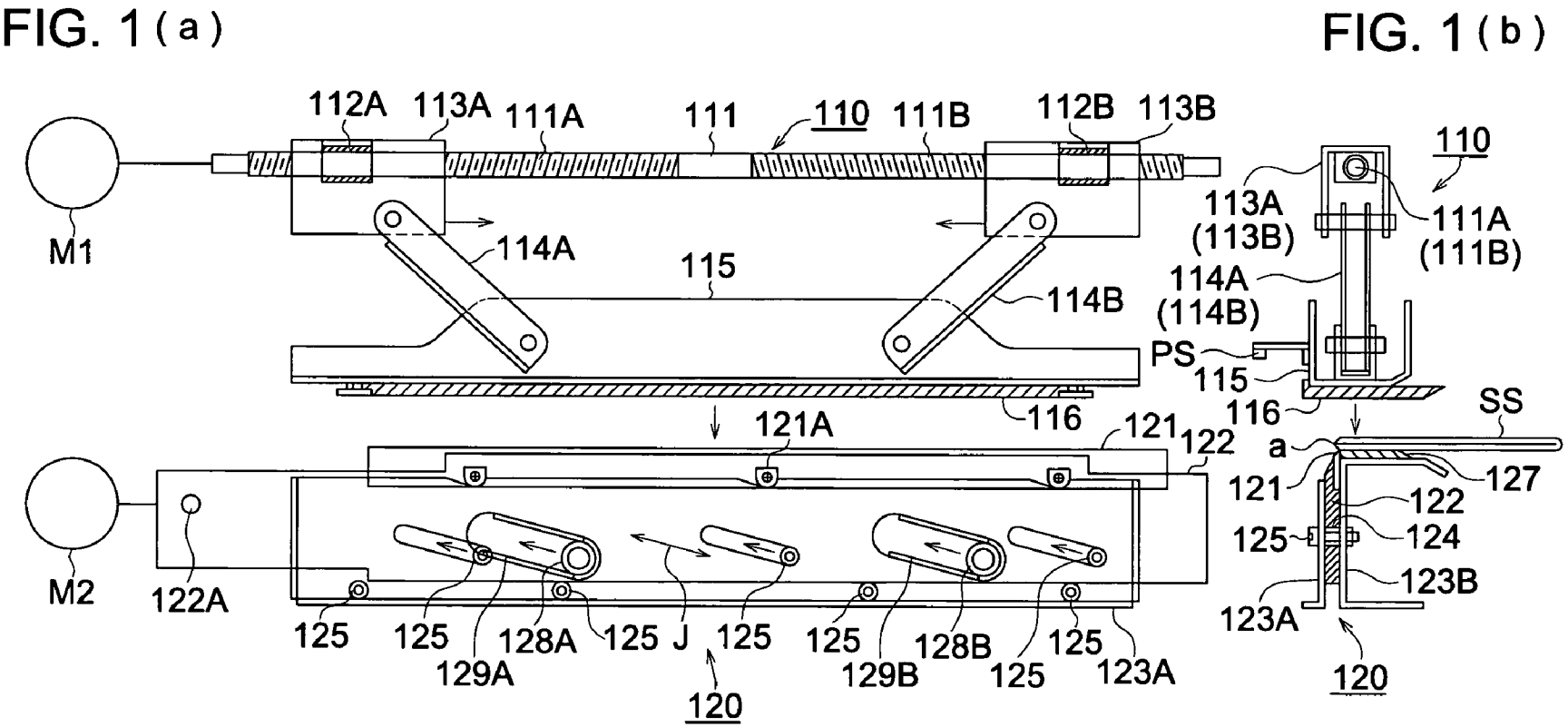
FIGS. 1(*a*) and 1(*b*) are the front view and side surface view of the major sections representing the standby state of a cutting device.

The following describes the details of the present invention with reference to embodiments given in the drawings.

[Cutting Device]

FIG. 1(*a*) is a front view of the major sections representing the standby state of a cutting device 100. FIG. 1(*b*) is a side view of the major sections thereof.

A blade receiving member drive unit 110 is arranged on the upper part of the main body of the cutting device 100, and a cutting blade moving unit 120 is mounted on the lower part of the main body.

The edge portion "a" of the sheet bundle SS conveyed to the cutting device 100 is cut by the vertical lowering of the blade receiving plate of the blade receiving member drive unit 110 and the rising of the cutting blade 121 of the cutting blade moving unit 120 in the oblique direction.

A rotary shaft 111 with both ends supported is mounted on the upper part of the blade receiving member drive unit 110. The rotary shaft 111 is driven by a motor M1. The rotary shaft 111 is provided with threaded sections 111A and 111B having twist angles formed in the direction opposite each other. The threaded section 111A is meshed with a screw 112A, while the threaded section 111B is meshed with a screw 112B. The traveling member 113A holding the screw 112A and traveling member 113B holding the screw 112B perform a linear motion in the direction opposite each other in response to rotation of the rotary shaft 111.

The bottom end of the connecting member 114A supported swingably on a portion of the traveling member 113A is engaged with the illustrated upper left of the edge portion pressing member 115 which is supported movably in the vertical direction. Similarly, the bottom end of the connecting member 114B supported swingably on a portion of the traveling member 113B is engaged with the illustrated upper right of the edge portion pressing member 115 which is supported movably in the vertical direction.

Accordingly, the rotary shaft 111 is driven by the drive of the motor M1, and the traveling members 113A and 113B are moved in the lateral direction. This causes a change in the inclination of the connecting members 114A and 114B, and the edge portion pressing member 115 is moved in the vertical direction.

A blade receiving plate 116 is secured on the lower surface of the edge portion pressing member 115, and is moved together with the edge portion pressing member 115 in the vertical direction. The blade receiving plate 116 is formed by a resin.

The cutting blade moving unit 120 is constituted by a holding unit, which is composed of a cutting blade 121, a cutting blade holder 122, support plates 123A and 123B, spacer holding member 124 and connecting member 125; and a holding base 127.

The cutting blade 121 with a cutting edge formed on the upper top part thereof is secured on the cutting blade holder 122 by a threaded member 121A. The cutting blade holder 122 is supported movably between opposite surfaces of a pair of support plates 123A and 123B arranged in parallel with each other. A spacer member 124 is interposed between the opposite surfaces of the support plates 123A and 123B. The cutting blade holder 122 is held at a space that allows traveling.

The connecting member 125 is led through the support plates 123A and 123B and hollow cylindrical spacer member 124, and the support plates 123A and 123B are held at a predetermined space and are tightened.

The space of the sliding surface opposite the support plates 123A and 123B based on set by the spacer member 124 is set 0.1 through 0.5 mm with respect to the thickness of the cutting blade holder 122, whereby the cutting blade holder 122 can freely travel in the vertical direction.

The connecting member composed of a connecting member 125 and spacer member 124 is arranged on a plurality of positions of the support plates 123A and 123B, thereby firmly retaining a predetermined space.

The rollers 128A and 128B are secured on the cutting blade holder 122, and are guided respectively by the guiding members 129A and 129B placed in downward sloping arrangement.

The pin 122A secured on the cutting blade holder 122 is moved linearly in the lateral direction by the drive unit connected to the motor M2. When the cutting blade holder 122 is moved linearly in the lateral direction through the pin 122A, the rollers 128A and 128B secured to the cutting blade holder 122 move along the guiding members 129A and 129B obliquely in the vertical direction as indicated by arrow mark J.

With the edge portion "a" as a leading edge, the sheet bundle SS having been fed to the cutting device 100 is conveyed on the mounting base 127 of the cutting blade moving unit 120 by a conveying unit (not illustrated), and is stopped at a predetermined position. At this stopped position, the sheet bundle SS is interposed between by the mounting base 127 and blade receiving plate 116 traveling downward. Then the edge portion "a" is cut by the cutting blade 121 traveling upward.

The following describes the operation of the cutting device 100.

At the standby positions, the traveling member 113A is located at the left end, while the traveling member 113B lies at the right end. The blade receiving plate 116 is placed at the highest position, and the cutting blade 121 is at the lowest position.

When the sheet bundle SS has come to the cutting device 100, the motor M1 starts to drive the traveling members 113A and 113B, and the edge portion pressing member 115 is fed downward through the connecting members 114A and 114B. The motor M1 stops at the position wherein the edge portion pressing member 115 is detected by a detector PS, and the edge portion pressing member 115 stops. The position of the edge portion pressing member 115 being stopped is determined by setting the position of the detector PS. The position of the detector PS is determined by the number of sheets constituting the sheet bundle SS. Accordingly, the lowering position of edge portion pressing member 115 is determined by the number of sheets constituting the sheet bundle SS preset on the operation section of the image forming system.

At the time of cutting to be described later, the edge portion pressing member 115 is pressed against the sheet bundle SS with such a great force that prevents misregistration from occurring even when a lateral force is applied by the cutting blade 121 to a plurality of sheets placed on top of one another.

Upon completion of pressing by the pressing of the sheet bundle SS, the motor M2 starts up to move the cutting blade 121 to the left top indicated by the arrow mark J. The sheet bundle SS is cut by the traveling of the cutting blade 121. The cutting operation of the cutting blade 121 is provided by sliding of the cutter, and therefore, cutting is possible with a relatively small drive force. Furthermore, even if there are a great number of sheets to be cut, only the traveling stroke of the cutting blade 121 is changed. The drive force does not change.

When all the sheets of the sheet bundle SS have been cut, the edge of the cutting blade 121 comes in contact with the blade receiving plate 116 to increase the drive force of the cutting blade 121. Upon detection of an increase in this drive force, namely, an increase in the load of the motor M1, the controller stops the drive of the motor M2. Thus, all the sheets of the sheet bundle SS are cut.

Upon completion of cutting of the edge portion, the motor M2 runs in the backward direction, and the cutting blade 121 travels down to a predetermined position obliquely to the lower right in FIG. 1(*a*).

Upon completion of downward traveling of the cutting blade 121, the edge portion pressing member 115 goes up to the initial position.

Upon completion of upward traveling of the edge portion pressing member 115, a fold holding member and receiving plate (not illustrated) having interposing the position close to the fold "b" of the sheet bundle SS have returned to the initial position. Then the edge portion pressing member 115 and blade receiving plate 116 travel upward, and the sandwiching of the sheet bundle SS is released.

The cutting operation of the edge portion of the sheet bundle SS is terminated by a series of operations discussed so far.

Figure 2:
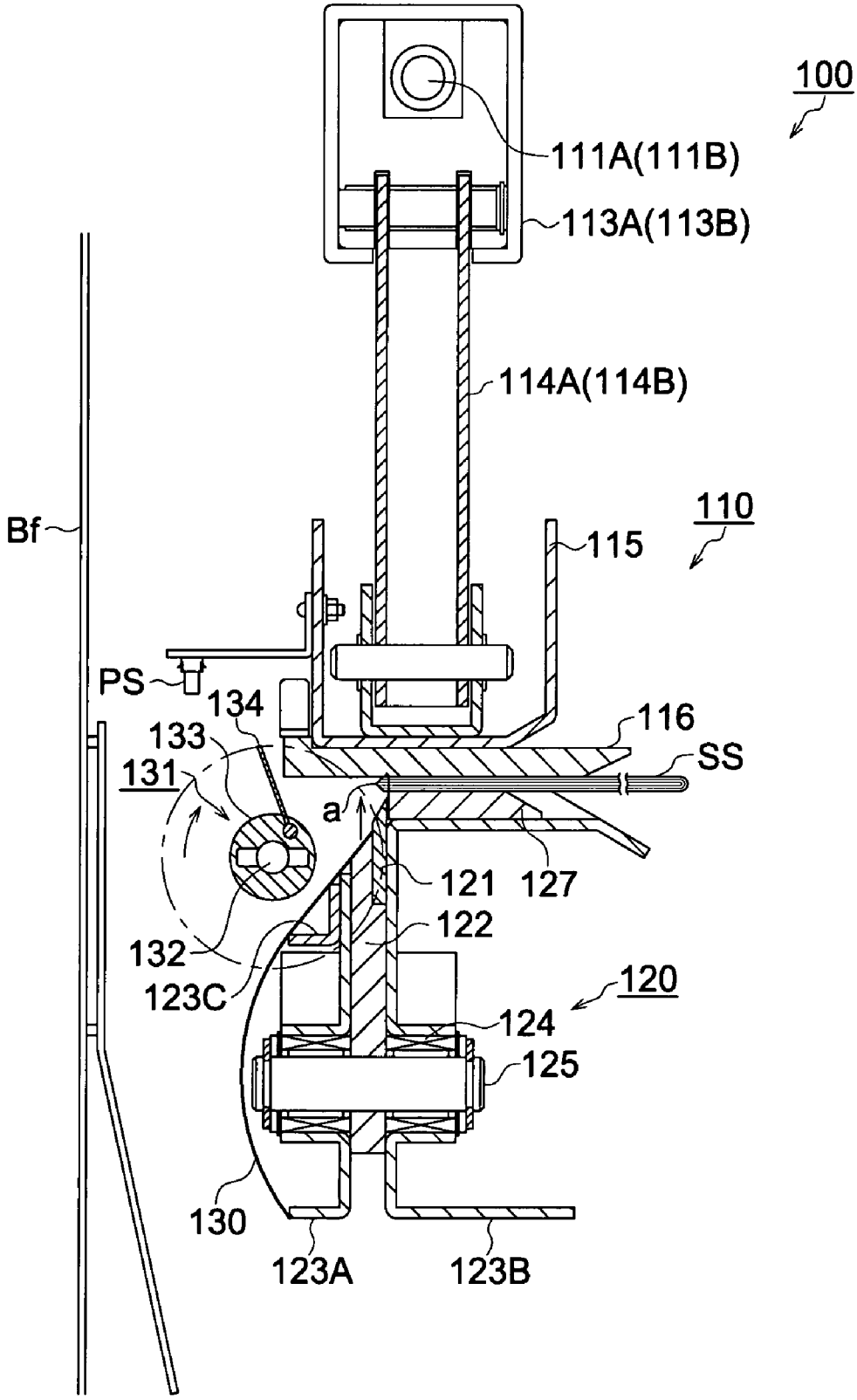
FIG. 2 is a cross sectional view of a cutting device.
Figure 3:
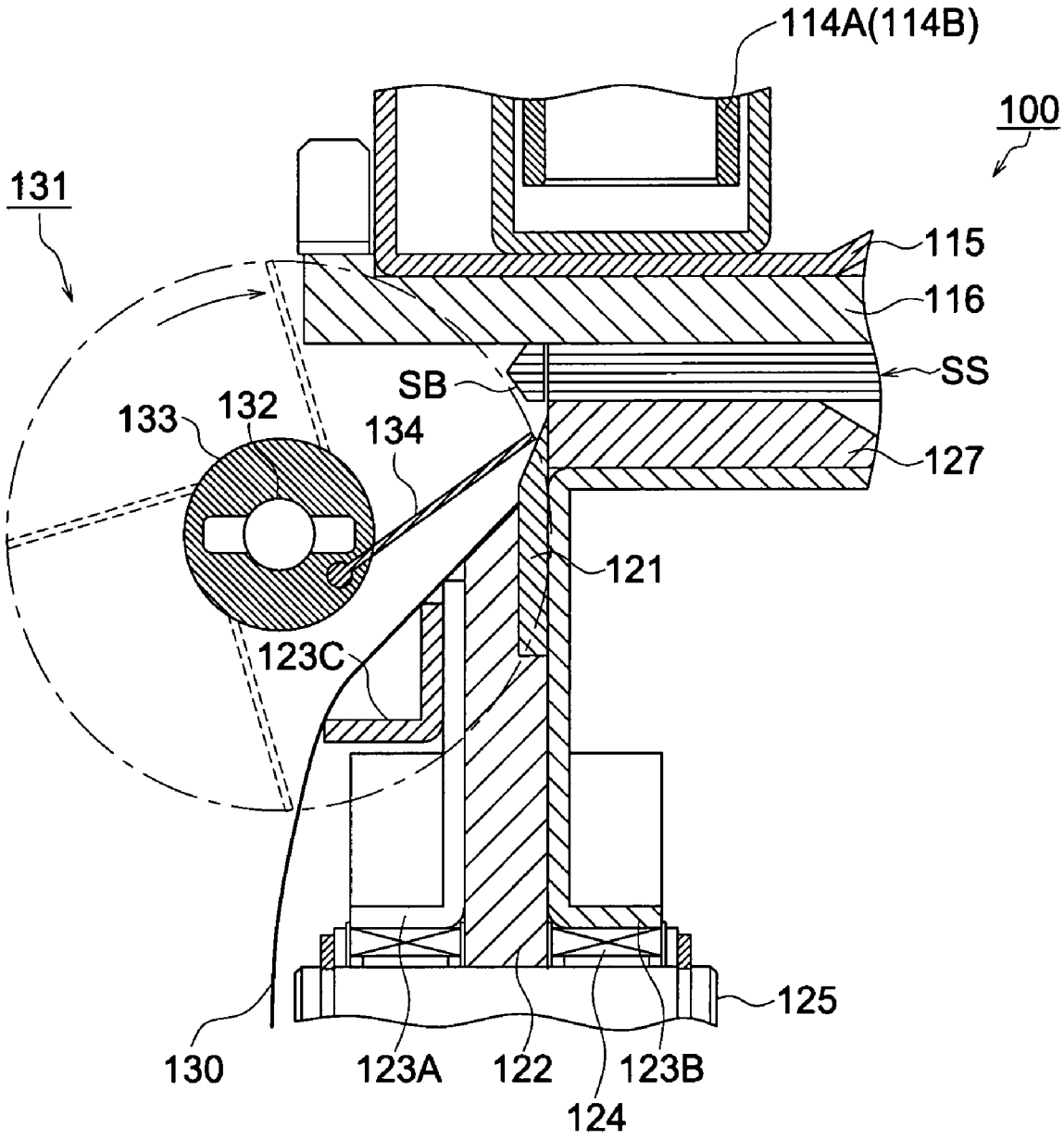
FIG. 3 is an enlarged cross sectional view of a cutting device.

FIG. 2 is a cross sectional view of the cutting device 100. FIG. 3 is an enlarged cross sectional view of the cutting device 100.

The cutting device 100 cuts the edge portion "a" which is the edge portion of the sheet bundle SS, using a cutting blade 121 arranged below the conveyance path of the sheet bundle SS and a blade receiving plate 116 located above the conveyance path. The cutting blade 121 is secured on the movable cutting blade holder 122. The cutting blade holder 122 is slidably supported by the support plates 123A and 123B, and can be moved obliquely in the upward direction by a drive unit (not illustrated).

Based on the traveling of the cutting blade holder 122 obliquely in the upward direction, the cutting blade 121 cuts the edge portion "a" of the sheet bundle SS placed on the top surface of the mounting base 127 and pressed against the blade receiving plate 116.

The blade receiving plate 116 is fed upward through the connecting members 114A and 114B rocked by the drive source (not illustrated), and is pressed against the sheet bundle SS placed on the top surface of the mounting base 127. At the same time, the blade receiving plate 116 comes in close contact with the tip of the cutting blade 121, whereby the edge portion "a" of the sheet bundle SS is cut.

One end of the guiding member 130 guiding the chips downward is bonded onto the upper inclined plane of the cutting blade holder 122 by means of a double-faced tape. The intermediate section of the guiding member 130 covers the support plate 123A, L-shaped member 123C and connecting member 125. Except for the cutting blade 121 that can be replaced, the guiding member 130 covers the entire area on the front side Bf (left in FIG. 2) of the finisher B. Accordingly, the guiding member 130 prevents the chips SB from sticking to these members. The chips SB in the sense in which this term is used here refer to small pieces of paper that is produced at the time of cutting, as well as minute paper dusts.

The guiding member 130 used preferably for antistatic measures is made of the nylon, PVC, PET, polycarbonate or other resin material containing a conductive material such as carbon, metal and metallic oxide, wherein such a material is processed in a sheet. This guiding member 130 made of such a material prevents sticking due to static electricity. Furthermore, the conductive guiding member 130 is preferably grounded. A metallic plate such as an aluminum alloy and stainless steel can also be as a conductive guiding member 130, in addition to the above.

The chips SB having been cut fall down the inclined slope of the cutting blade and slide down along the smooth curved surface of the guiding member 130.

To tap the chips SB cut off by the cutting blade 121 and to drop them, a rotating paddle unit 131 is arranged on the side of the cutting blade 121 in the vicinity of the cutting blade 121. The paddle unit 131 incorporates a paddle shaft 132, a plurality of holding members 133 provided in the axial direction of the paddle shaft 132, and a plurality of vane-formed paddles 134 arranged on each of the holding members 133.

Figure 4:
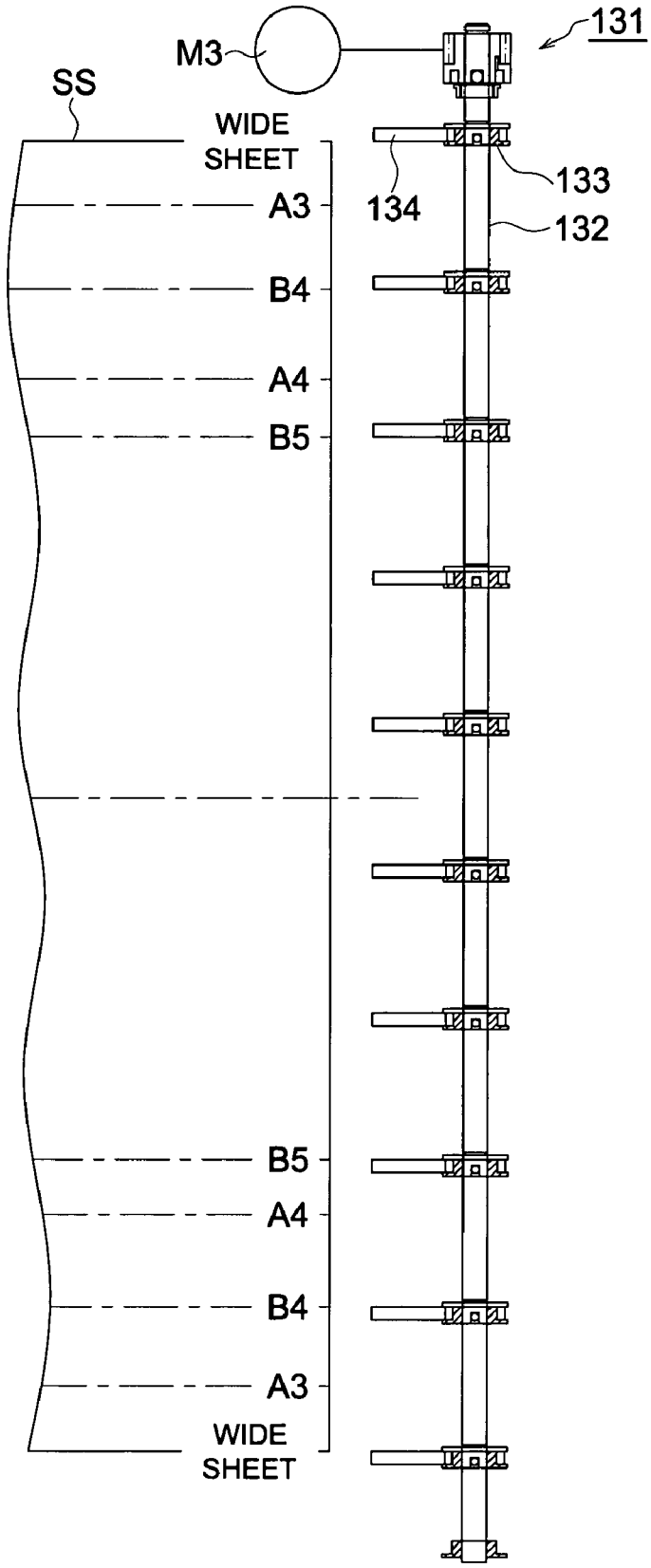
FIG. 4 is a plan view of a paddle and sheet bundles of various sizes to be cut.

As shown in FIG. 4, the paddle shaft 132 is driven by the drive unit including the motor M3. The holding members 133 are arranged on a plurality of positions of the paddle shaft 132. Each of the holding member 133 is provided with a paddle 134.

As can be seen from FIGS. 3 and 4, a plurality of paddles 134 are arranged in one row at the same phase on the paddle shaft 132 through the holding members 133. This arrangement avoids the possibility that the chips SB about to be dropped by a paddle are again blown upward. To be more specific, if a plurality of rows of paddles are arranged at different phases, the paddle scraping force will be increased. As a result, the chips SB about to be dropped are again blown upward more easily.

The paddle 134 of the paddle unit 131 is made of an elastic thin plate, for example, a thin plate of polyurethane having a thickness of about 1 mm.

Without touching the tip of the cutting blade 121, the leading edge of the paddle 134 of the paddle unit 131 touches the side surface close to the edge of the cutting blade 121 without touching the edge itself of the cutting blade 121. If the leading edge of the paddle 134 touches the edge of the cutting blade 121, the consumption of the paddle 134 will be accelerated. To prevent this, arrangement is made to ensure that the leading edge of the paddle 134 does not reach the edge of the cutting blade 121.

At the time of rotation, the leading edge of the paddle 134 of the paddle unit 131 rubs the side surface of the cutting blade 121, thereby forcibly dropping the chips SB statically adhering to the side surface of the cutting blade 121.

In the cutting device of the present invention, when the edge part of the booklet is cut, the paddle 134 is driven, and the chips SB are dropped and stored in the chip container 142 located below. If the scraping of the rotating paddle 134 is too powerful, the loose chips SB about to be dropped will be scattered and blown up, and will adhere to the members of the cutting device 100. This will cause operation failure, and may result in the conveyance failure of the sheet bundle SS.

To avoid blowing up of the chips SB while maintaining the performance of dropping of the chips SB, the paddle 134 should preferably be driven at an adequate rotating speed.

When paddles 134 are is arranged at a plurality of positions in the axial direction of the paddle shaft 132, chips SB can be removed by scraping in response to the size of the sheet such as wide-, A3-, B4-, A4- or B5-sized sheet.

The chips SB having been cut may be kept tilted with respect to the cut end without being dropped. In this case, since the paddles 134 are is arranged at a plurality of positions in the axial direction of the paddle shaft 132, any of the paddles 134 can touch the chips SB to remove them.

FIG. 4 is a plan view of a paddle unit 131 and sheet bundles SS of various sizes to be cut.

The paddles 134 mounted on the holding member 133 are arranged at a plurality of positions (ten positions in the drawing) in the crosswise direction perpendicular to the direction of conveyance. A plurality of paddles 134 are arranged opposite the edge portion "a" of the sheet bundle SS of various sizes.

Figure 5:
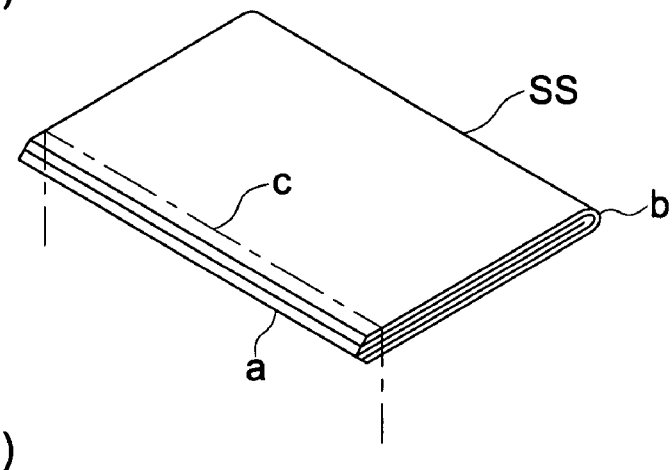
FIGS. 5(*a*) through 5(*d*) are perspective view and cross sectional view representing various types of sheet bundles having been finished.
Figure 5:
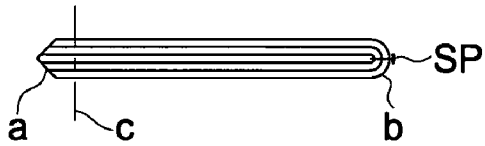
Figure 5:
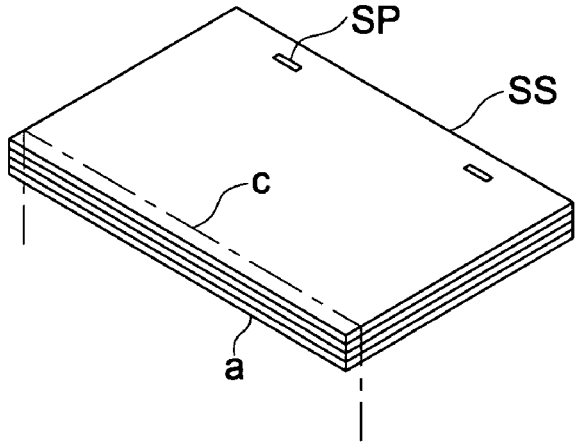
Figure 5:
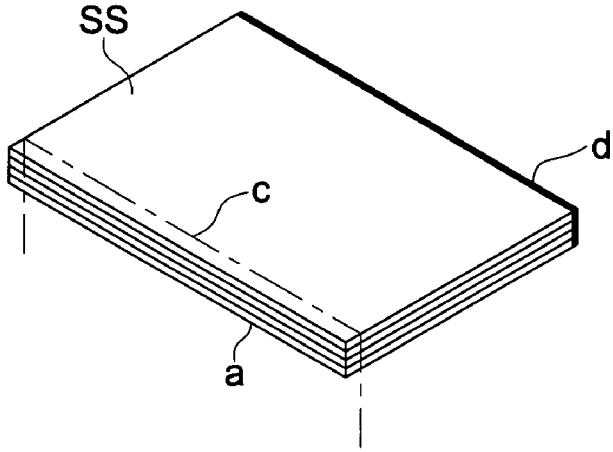

FIGS. 5(*a*) through 5(*d*) are perspective view and cross sectional view of sheet bundles of various types having been finished. FIG. 5(*a*) is a perspective view representing the sheet bundle SS having been center-folded and center-bound. FIG. 5(*b*) is a cross sectional view of the sheet bundle SS. FIG. 5(*c*) is a perspective view showing the sheet bundle SS having been side-bound. FIG. 5(*d*) is a perspective view showing the sheet bundle SS having been glued. In these drawings, "a" shows the edge portion, "b" the fold, "c" the cutting line, and "SP" the wire staple, and "d" the bonded portion.

[Finisher Provided With a Cutting Device and Image Forming Apparatus]

Figure 6:
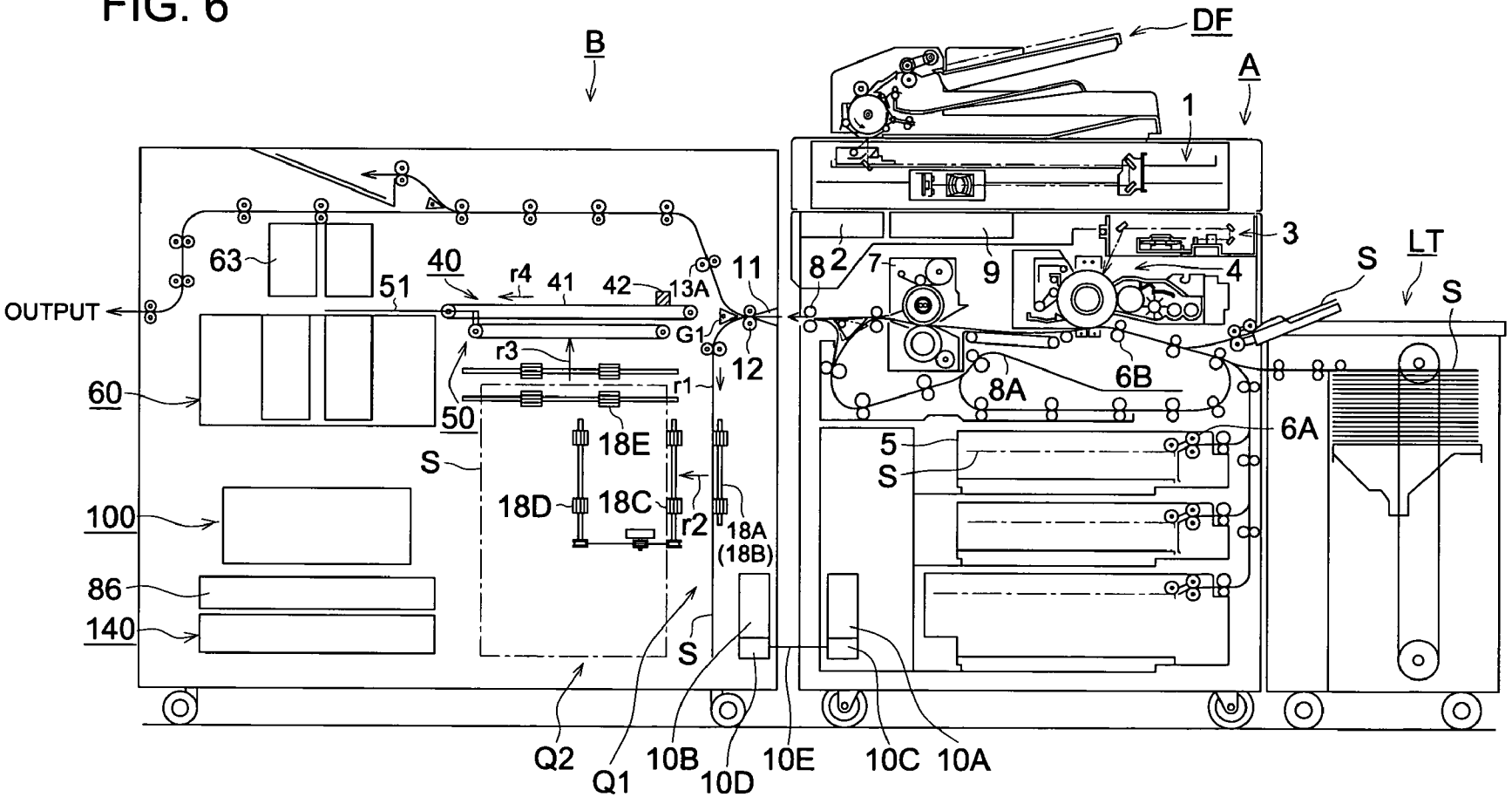
FIG. 6 is an overall schematic diagram showing an image forming apparatus incorporating a finisher having a cutting device of the present invention, and an image forming apparatus main body.

The finisher B of the present invention denotes a finisher provided with a cutting device 100, and the image forming apparatus refers to the image forming apparatus wherein a finisher incorporating a cutting device is connected integrally with the image forming apparatus main body A of FIG. 6. The finisher incorporating the cutting device of the present invention can be designed so that it can be used independently. It is to be understood that the finisher of the present invention and the image forming apparatus provided with the finisher are not restricted to the following embodiments.

[Image Forming Apparatus Main Body]

FIG. 6 is an overall schematic diagram showing an image forming apparatus incorporating a finisher B containing a cutting device 100 and an image forming apparatus main body A.

The image forming apparatus is constituted by an image forming apparatus main body A, automatic document feeder DF, finisher B and large capacity sheet feeding unit LT.

The illustrated image forming apparatus main body A contains an image reading section 1, image processing section 2, image writing section 3, image forming section 4, sheet feeding cassette 5, first sheet feed section 6A, second sheet feed section 6B, fixing unit 7, sheet ejection section 8, and automatic duplex unit (ADU) 8A.

A finisher B containing a cutting device 100 is connected to the side of the sheet ejection section 8 on the illustrated left side surface of the image forming apparatus main body A.

The operation section 9 selects and sets the processing function of the image forming apparatus including an image forming apparatus main body A, finisher B and others.

The main control section 10A of the image forming apparatus main body A is connected to the finisher control section 10B of the finisher B through communication sections 10C and 10D, and communication network 10E.

[Finisher]

Figure 7:
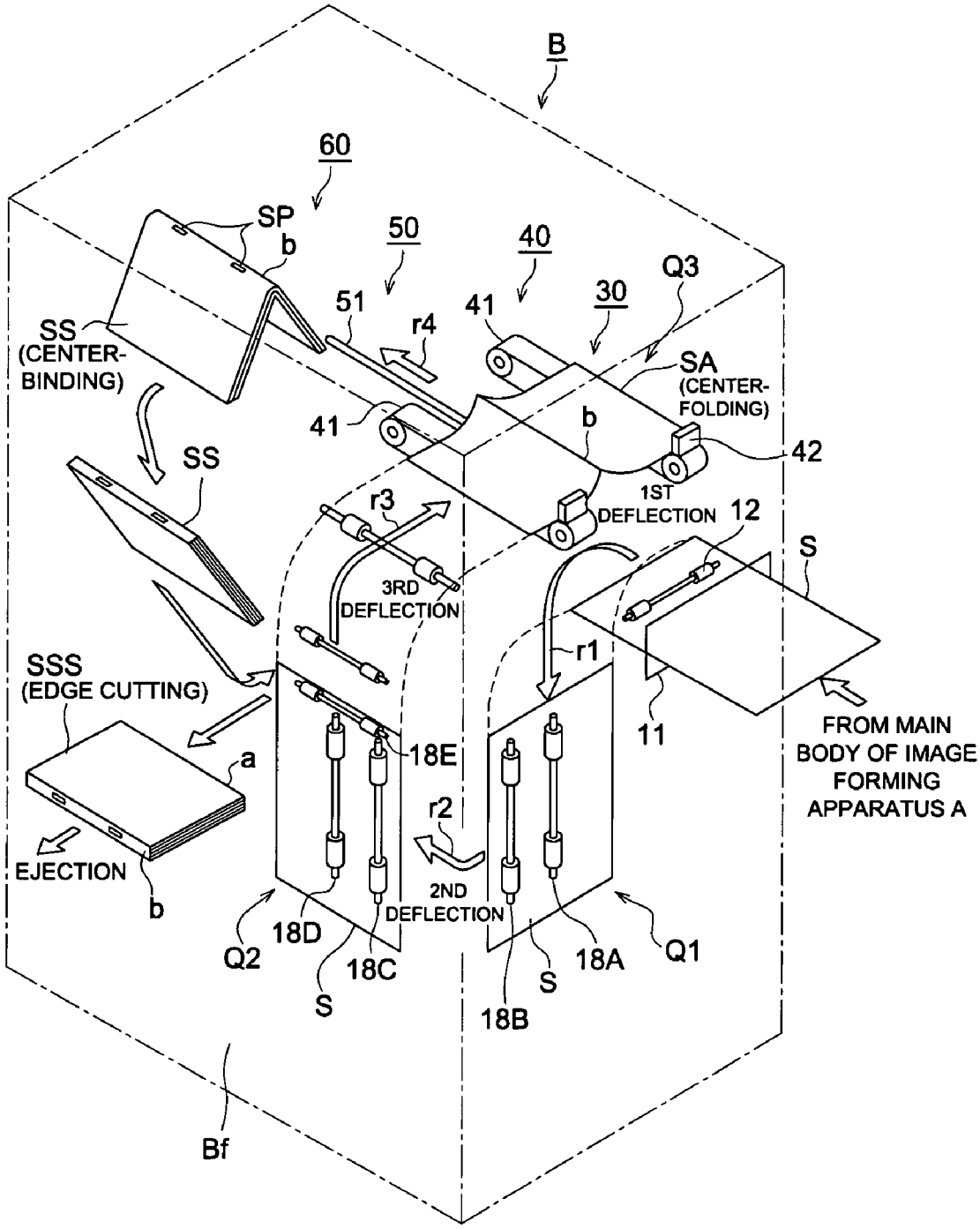
FIG. 7 is a schematic diagram representing how sheets are conveyed in the processes of center folding and center binding in the finisher.
Figure 8:
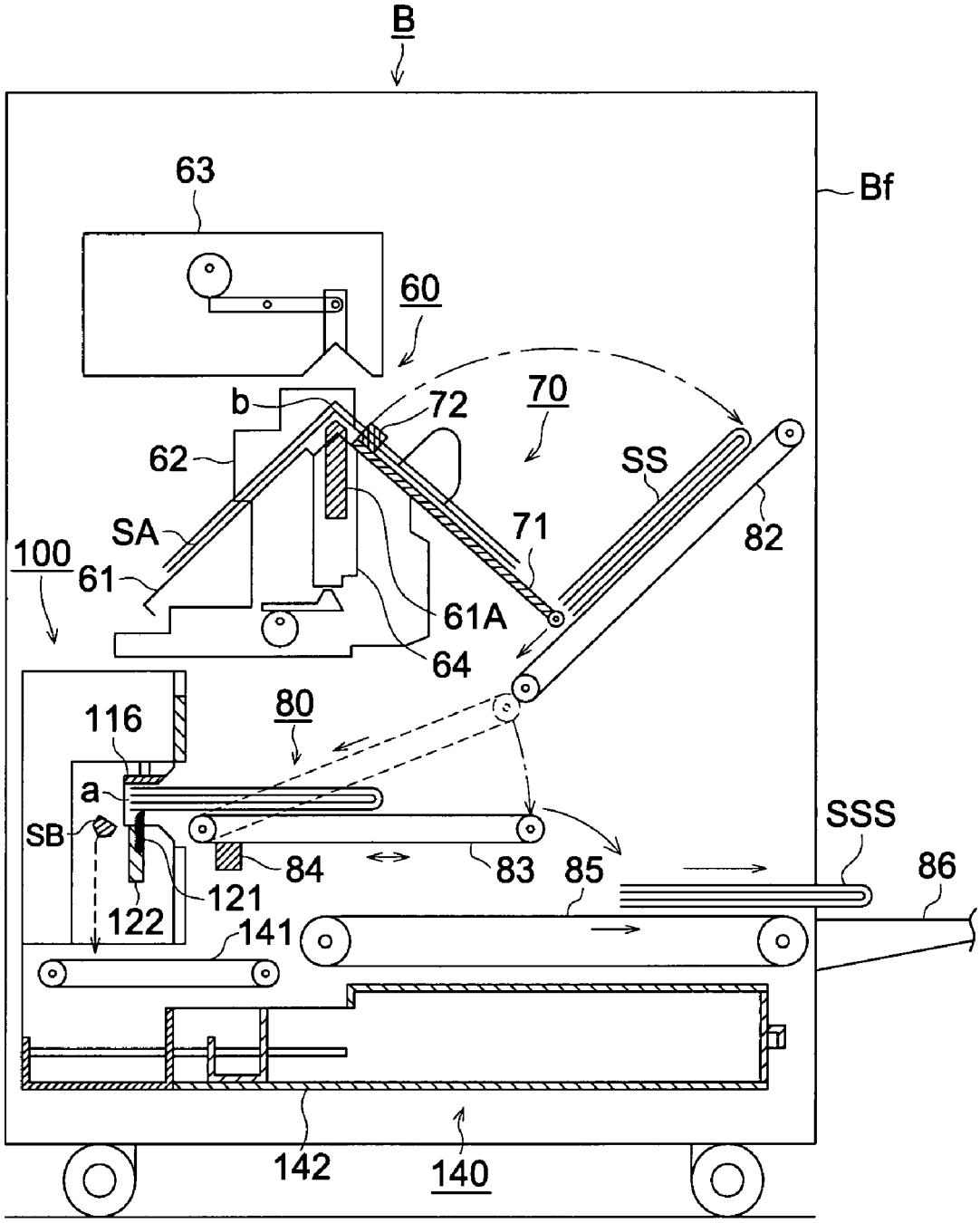
FIG. 8 is a left side elevation view of the finisher.

FIG. 7 is a schematic diagram representing how sheets are conveyed in the processes of center folding and center binding in the finisher B. FIG. 8 is a left side elevation view of the finisher.

When the process of the center folding and center binding in bookbinding is programmed in the operation section 9 as shown in FIGS. 7 and 8, the sheets S ejected from the image forming apparatus main body A are led to the inlet section 11 of the finisher B. They are interposed between the inlet rollers 12, and are conveyed to the sheet conveyance path 1 below the conveyance path switching member G1.

The sheets S conveyed to the sheet conveyance path 1 below the conveyance path switching member G1 are fed downward approximately in the vertical direction. The sheets S then stop temporarily at a predetermined position to be stored. At this first stop position Q1, a plurality of the succeeding sheets S are placed one on top of another and are stored.

The sheets S having been stored are conveyed in the perpendicular direction by a pair of conveyance rollers 18A and 18B, a pair of first conveyance rollers 18C and 18D, and the guide plate (not illustrated). The sheets are conveyed along the sheet conveyance path r2 leading to the front side Bf inside the finisher B, with the sheet surface in the upright position, and are stopped temporarily at the second stop position Q2.

The sheets S are conveyed in the vertical direction by a pair of second conveyance rollers 18E and are conveyed in the horizontal direction after the direction has been changed.

An aligning unit (not illustrated) is arranged on the downstream side in the sheet conveying direction of the sheet conveying path r3. The sheet tip portion is positioned by engagement with the alignment unit, and the sheets are stopped temporarily at the third stop position Q3.

A center folding section 30 is arranged on the downstream side in the sheet conveying direction of the aligning unit. The center folding section 30 is composed of a folding roller, folding plate and others, and performs center-folding processing.

After having been folded in two by the center folding section 30, the folded sheets SA with a fold "b" formed thereon is fed back to the original horizontal sheet conveyance path. The folded sheets SA is fed to the sheet conveyance path r4 on the extension of the fold "b" by the conveying belt 41 of the conveyance unit 40, conveyance claw 42 and introduction guiding member 51 of the folded sheets guiding unit 50, and is then fed to the center-binding unit 60.

As described above, the center folding section 30 applies a process of center-folding to a small number of sheets S composed of one through three sheets to create a fold "b" thereon. These sheets are sequentially fed to the center-binding unit 60, thereby producing the sheet bundle SS containing a smaller bulge in the fold "b".

The folded sheets SA subjected to the process of center-folding processing by the center folding section 30 is conveyed toward the sheet conveyance path r4 by the conveyance unit 40, and is placed on the saddle-shaped stacking unit 61 of the center-binding unit 60. The succeeding folded sheets SA subjected to the process of center-folding are also conveyed along the sheet conveyance path r4, and are stacked on the saddle-shaped stacking unit 61.

The saddle-shaped stacking unit 61 is composed of two guide plates approximately perpendicular to each other, and is secured on the main body of the finisher B. In the vicinity of the top of the saddle-shaped stacking section 61, a pressing member 61A spring-energized for vertical traveling is arranged in a form supported by the staple receiving mechanism 64.

The top of the pressing member 61A is formed in a convex having approximate right angles on the top, and the fold "b" of the folded sheets SA subjected to the process of center-folding is placed on the edge line of the top.

A plurality of folded sheets SA placed on the saddle-shaped stacking unit 61 and pressing member 61A are position-adjusted by a width aligning unit 62.

The stapling mechanism 63 is arranged fixedly above the pressing member 61A. Inside the saddle-shaped stacking unit 61, the pressing member 61A and staple receiving mechanism 64 are supported movably in the vertical direction.

Two sets of the two-split structure staplers made up of a stapling mechanism 63 and staple receiving mechanism 64 are arranged in the direction of the sheet fold. When the process of center-binding is programmed on the operation section, the staple receiving mechanism 64 goes upward, and performs the process of center-binding. To be more specific, two sets of staplers drive a wire staple SP at two positions in a form separated at center into two parts, along the fold "b" of the folded sheets SA on the pressing member 61A.

The sheet bundle SS subjected to the process of center-binding by the center-binding unit 60 is held by the support member 72 secured on the tip portion of the arm member 71 of the booklet removing unit 70. The sheet bundle SS is rocked by the arm member 71 in the direction of an arrow mark of one-dot chain line, and is conveyed to the booklet conveying unit 80.

The sheet bundle SS fed by the booklet conveying unit 80 is placed on the conveying belt 82. The sheet bundle SS is fed obliquely in the downward direction by the rotation of the conveying belt 82. It is then held in the inclined position, and is conveyed by the rotating conveying belt 83 to stop at a predetermined position. After that, the conveying belt 83 is rocked and is supported in the horizontal position.

The edge portion "a" as the free end opposite the fold of the sheet bundle SS placed on the conveying belt 83 in the horizontal position is uneven due to the number of the sheets of the sheet bundle SS, and therefore, the edge portion "a" is trimmed and made uniform by cutting with a cutting blade 121 and blade receiving plate 116 of the cutting device 100 of the present invention.

The booklet SSS created by cutting is placed on the conveying belt 83 rotating in the backward direction, and is conveyed by an aligning member 84 secured on the conveying belt 83, the trailing edge of the booklet SSS being pressed. The booklet SSS then falls down in the arrow-marked direction from the tip portion of the conveying belt 83. The booklet SSS having fallen is ejected to the ejection tray 86 arranged outside the front side Bf of the finisher B by the rotating ejection belt 85.

A chip processing section 140 is installed below the booklet conveying unit 80 and cutting device 100. The chips SB with the edge portion "a" being cut off by the cutting blade 121 and the blade receiving plate 116 of the cutting device 100 fall on the rotating chip conveying belt 141 and are conveyed to be stored in the chip container 42.

The embodiment of the present invention has been described with reference to the cutting device 100 of the finisher B containing a center folding and center binding function connected to the main body of the image forming apparatus. The present invention is also applicable to the cutting device of the finisher that performs center-folding processing after center-binding processing. Further, the present invention is also applicable to the sheet bundle making apparatus wherein the finisher B is a gluing bookbinding apparatus or the like.

The finisher equipped with the cutting device of the present invention can be connected, on a selective basis, with a bookbinding apparatus connected to a light type printing machine, thereby ensuring a consistent multi-purpose and multi-function process of finishing.

The present invention is also applicable to the finisher connected to an image forming apparatus of a photocopier, printer, facsimile, multifunction machine and others. This will provide the similar advantages.

In the aforementioned embodiment, electrophotographic technology has been mentioned as an example of recording method. Without being restricted thereto, the present invention is applicable to other recording methods such as an inkjet method.

Further, the finisher of the present invention can be used as the stand-alone finisher separated from the image forming apparatus, thereby providing various forms of folding, binding and cutting.

The cutting device, finisher and image forming apparatus of the present invention provide the following advantages.

1. The present invention eliminates the possibility that the chips generated by the cutting device for cutting the edge portion of the sheet bundle having been conveyed stick in the vicinity of the cutting blade, and remain unremoved. At the same time, the present invention also prevents chips from scattering due to blowing up when a process of cutting is applied to a booklet, and ensures that these chips are completely removed from the vicinity of a cutting blade and are completely stored into the chip container.

2. In a finisher for aligning a plurality of sheets and bookbinding after finishing such as center-folding processing and center-binding processing, the present invention ensures the reliable and stable operation of a cutting device for cutting the edge portion of the sheet bundle bound in a form of a book.

3. The present invention provides an image forming apparatus wherein the stable operation of the cutting device ensures continuous and high-speed operations of image forming and finishing without the drive of the image forming apparatus being stopped.

What is claimed is:

1. A cutting device that cuts an edge portion of a sheet bundle to an even length, in which a plurality of sheet have been stacked, using a cutting blade, the cutting device comprising:

(a) a paddle shaft capable of being rotated, which is connected to a drive source provided in the vicinity of the cutting blade; and (b) a plurality of paddles provided on the paddle shaft in a rotary axis direction thereof, the paddle shaft positioned such that each of the paddles is in a position such that a tip portion of the paddle rubs a side surface of the cutting blade without coming into contact with a cutting edge of the cutting blade when the paddle is rotated, and drops chips which have been cut by the cutting blade, wherein the plurality of paddles are arranged in a single line with the same phase as each other on the paddle shaft.

2. The cutting device of claim 1, wherein each of the plurality of paddles is attached on each of a plurality of holding members which is fixed on the paddle shaft.

3. The cutting device of claim 2, wherein each paddle is detachably attached on each of the holding members.

4. The cutting device of claim 1, wherein each of the paddles is formed by an elastic thin plate.

5. The cutting device of claim 1, wherein the cutting blade rises obliquely upward, and further comprising a receiving plate which drops downward to receive the cutting blade.

6. A finisher which aligns a plurality of sheets and binds the sheets to form a book, the finisher comprising the cutting device of claim 1, which cuts the edge portion of the sheet bundle that has been bound.

7. An image forming apparatus comprising: an image forming device which forms an image on a sheet; and the finisher of claim 6 which cuts by the cutting device the edge portion of the sheet bundle that has been formed to which the plurality of sheets on which images have been formed by the image forming device have been finished.

* * * * *